US008869365B2

(12) United States Patent
Faitel

(10) Patent No.: US 8,869,365 B2
(45) Date of Patent: Oct. 28, 2014

(54) RIVET GUIDE HEAD

(75) Inventor: William M. Faitel, New Baltimore, MI (US)

(73) Assignee: BTM Corporation, Marysville, MI (US)

( * ) Notice: Subject to any disclaimer, the term of this patent is extended or adjusted under 35 U.S.C. 154(b) by 782 days.

(21) Appl. No.: 13/167,856

(22) Filed: Jun. 24, 2011

(65) Prior Publication Data

US 2012/0324690 A1 Dec. 27, 2012

(51) Int. Cl.
*B23P 11/00* (2006.01)
*B21J 15/32* (2006.01)
*B21J 15/02* (2006.01)

(52) U.S. Cl.
CPC ..... *B21J 15/32* (2013.01); *B21J 15/025* (2013.01)
USPC ..... 29/243.53

(58) Field of Classification Search
USPC ..... 29/243.53, 255, 252, 238, 239, 29/243.5–244
See application file for complete search history.

(56) References Cited

U.S. PATENT DOCUMENTS

| | | | | |
|---|---|---|---|---|
| 3,942,235 | A | 3/1976 | Goodsmith et al. | |
| 4,130,922 | A | 12/1978 | Koett | |
| 5,267,383 | A * | 12/1993 | Sawdon | 29/243.5 |
| 5,339,983 | A | 8/1994 | Caple | |
| 5,465,868 | A | 11/1995 | Bonomi | |
| 5,636,426 | A | 6/1997 | Luckhardt et al. | |
| 5,727,302 | A * | 3/1998 | Sawdon | 29/436 |
| 5,752,305 | A | 5/1998 | Cotterill et al. | |
| 5,953,813 | A | 9/1999 | Sickels et al. | |
| 6,018,863 | A | 2/2000 | Altrock | |
| 6,263,561 | B1 | 7/2001 | Sickels et al. | |
| 6,592,015 | B1 | 7/2003 | Gostylla et al. | |
| 6,631,827 | B2 | 10/2003 | Goodsmith et al. | |
| 6,925,698 | B2 | 8/2005 | Goodsmith et al. | |
| 6,957,483 | B2 | 10/2005 | Woods | |
| 6,968,939 | B1 | 11/2005 | Mauer et al. | |
| 7,475,468 | B2 | 1/2009 | Mauer et al. | |
| 7,559,133 | B2 | 7/2009 | Chitty et al. | |
| 7,748,097 | B1 | 7/2010 | Matthews et al. | |
| 7,752,739 | B2 | 7/2010 | Mauer et al. | |
| 7,849,579 | B2 | 12/2010 | Craythorn et al. | |
| 2006/0248705 | A1 * | 11/2006 | Opper | 29/525.06 |
| 2007/0274804 | A1 | 11/2007 | Woods | |
| 2011/0173803 | A1 | 7/2011 | Naito et al. | |

OTHER PUBLICATIONS

AKH System Manual published or offered for sale prior to Jun. 2011, 17 pages.
AKH FAS-NER Drawing No. WIS-146, Jun. 2011, 1 page.
Rivet Guide Head published or offered for sale prior to Jun. 2011 by AKH, 1 page.

* cited by examiner

*Primary Examiner* — Lee D Wilson
*Assistant Examiner* — Nirvana Deonauth
(74) *Attorney, Agent, or Firm* — Price Heneveld LLP

(57) ABSTRACT

A rivet guide head that guides a rivet during a rivet machine drive stroke is provided. The rivet guide head includes a rivet guide body having a rivet guide surface defined along a rivet guide bore having a guide bore axis. A first elongated guide pin is disposed in the rivet guide head that extends along a first guide pin axis and has an outer engagement surface. The guide bore axis is substantially parallel to the first guide pin axis. The rivet guide head is configured to guide the rivet along the outer engagement surface of the first elongated guide pin during the drive stroke. According to further aspects, the first elongated pin deflects laterally outwardly during the drive stroke. A first biasing member is disposed in the rivet guide head and is configured to bias the elongated guide pin in a direction toward the guide bore axis.

24 Claims, 10 Drawing Sheets

RIVET GUIDE HEAD

BACKGROUND AND SUMMARY

The present invention relates generally to a fastener machine, and more particularly, to a rivet guide head that guides a rivet during a rivet machine drive stroke.

Rivet machines generally include a punch that is configured to engage and drive a rivet through workpieces to join the workpieces together. In general, the punch directs the rivet through a rivet guide head that guides the rivet in a desired orientation toward a selected area on the workpieces. With reference to FIGS. 2-9 of the Figures, one guide head constructed in accordance to the prior art is shown and generally identified at reference numeral 10. The guide head 10 is generally mounted to a punch guide 12. The guide head 10 generally includes a first pair of opposing plunger assemblies 14 and a second pair of opposing plunger assemblies 16. The first pair of opposing plunger assemblies 14 includes plungers 20 that are biased inwardly by biasing members 22. Similarly, the second pair of plunger assemblies 16 includes a second pair of plungers 24 that are biased inwardly by a second pair of biasing members 26.

A first pair of set screws 30 secures the first pair of plunger assemblies 14 to the guide head 10. A second pair of set screws 32 secures the second pair of plunger assemblies 16 to the guide head 10. During operation, the respective plungers 20 and 24 act on an outer surface 36 of a rivet 40. In this regard, the plungers 20 and 24 translate in a direction perpendicular to a guide bore axis to follow an outer profile of the surface 36 of the rivet 40 through the drive stroke.

As shown in FIG. 7, the first pair of plungers 20 are biased inwardly to contact an innermost diameter of the rivet 40 during translation of the rivet 40 through the guide head 10. The components of the guide head 10 according to prior art can pose a number of problems. For example, the plungers 20 and 24, the biasing members 22 and 26, as well as the set screws 30 and 32 are all relatively small pieces that can be difficult to assemble and tend to inadvertently be lost. The spring tension of the biasing members 22 and 26 is generally set by the respective set screws 30 and 32. Assembly of the set screws 30 and 32 can be difficult and generally awkward. In many examples, it is required to apply a flowable adhesive to an interface between the set screws 30, 32 and the guide head 10. In some examples during use, the rivet 40 can be caught or trapped between the first set of plungers 20 and the second set of plungers 24 (see FIG. 8). In other examples, the rivet 40 may become caught elsewhere such as between the second pair of plungers 24 prior to being driven into a workpiece.

In accordance with the present invention, a rivet guide head that guides a rivet during a rivet machine drive stroke is provided. The rivet guide head includes a rivet guide body having a rivet guide surface defined along a rivet guide bore having a guide bore axis. A first elongated guide pin is disposed in the rivet guide head that extends along a first guide pin axis and has an outer engagement surface. The guide bore axis is substantially parallel to the first guide pin axis. The rivet guide head is configured to guide the rivet along the outer engagement surface of the first elongated guide pin during the drive stroke. According to further aspects, the first elongated pin deflects laterally outwardly during the drive stroke. A first biasing member is disposed in the rivet guide head and is configured to bias the elongated guide pin in a direction toward the guide bore axis.

According to still other aspects, the first biasing member comprises an elongated elastomeric member that extends along a first member axis that is parallel and laterally offset from the guide bore axis. The rivet guide head is configured to slidably and concurrently engage the rivet at the rivet guide surface with the engagement surface of the first elongated member during the drive stroke. According to another aspect of the present invention, the first elongated pin deflects to a guide position upon initial engagement with the rivet and substantially remains at the guide position subsequent to the initial engagement through the drive stroke until the rivet is urged to a location adjacent a terminal end of the first elongated pin. In other features, a second elongated guide pin and a second biasing member are both disposed in the rivet guide head and cooperate with the first elongated guide pin and first biasing member to guide the rivet through the rivet guide head through the drive stroke.

Further advantages and areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The drawings described herein are for illustrative purposes only of selected embodiments and not all possible implementations, and are not intended to limit the scope of the present disclosure.

Figure 18:
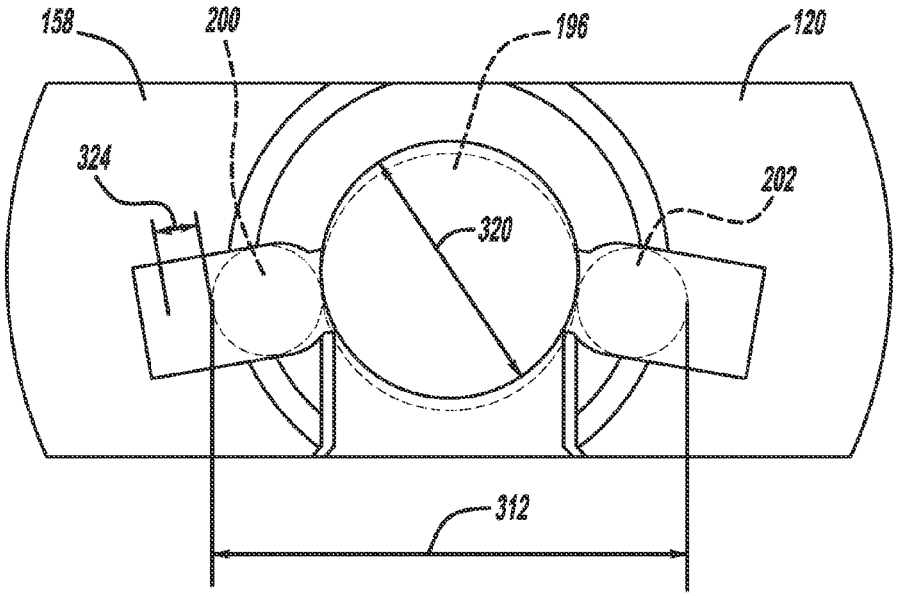
Figure 19:
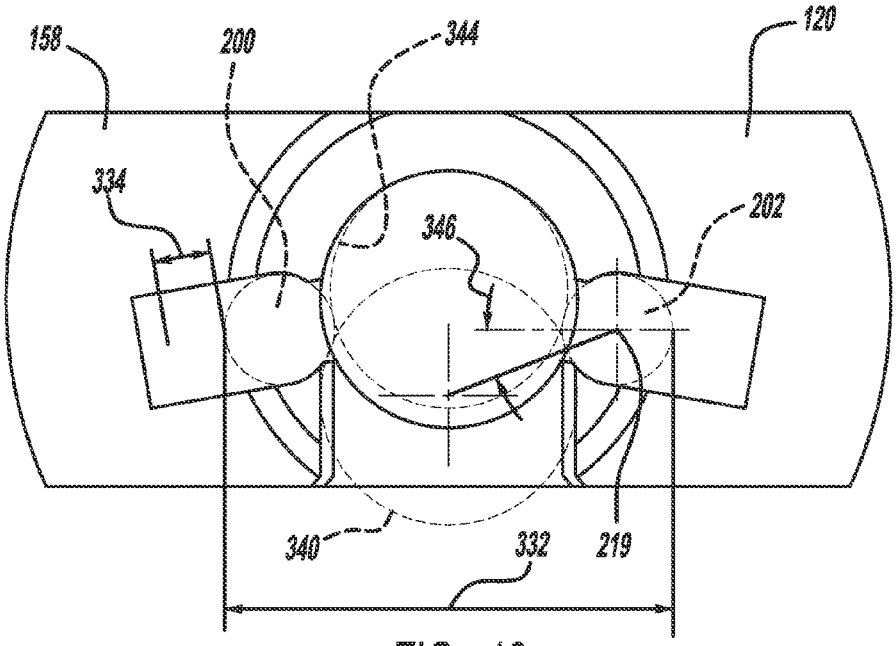

FIG. 18 is a cross-sectional view taken generally through the rivet guide head and illustrating the guide pins deflected to a third position corresponding to accommodate a rivet at its maximum diameter while being located into the rivet guide bore; and FIG. 19 is a cross-sectional view taken generally through the rivet guide head and illustrating the guide pins at a fourth location generally corresponding to no rivet being in the rivet guide bore.

Corresponding reference numerals indicate corresponding parts throughout the several views of the drawings.

DETAILED DESCRIPTION

Example embodiments will now be described more fully with reference to the accompanying drawings.

Figure 1:
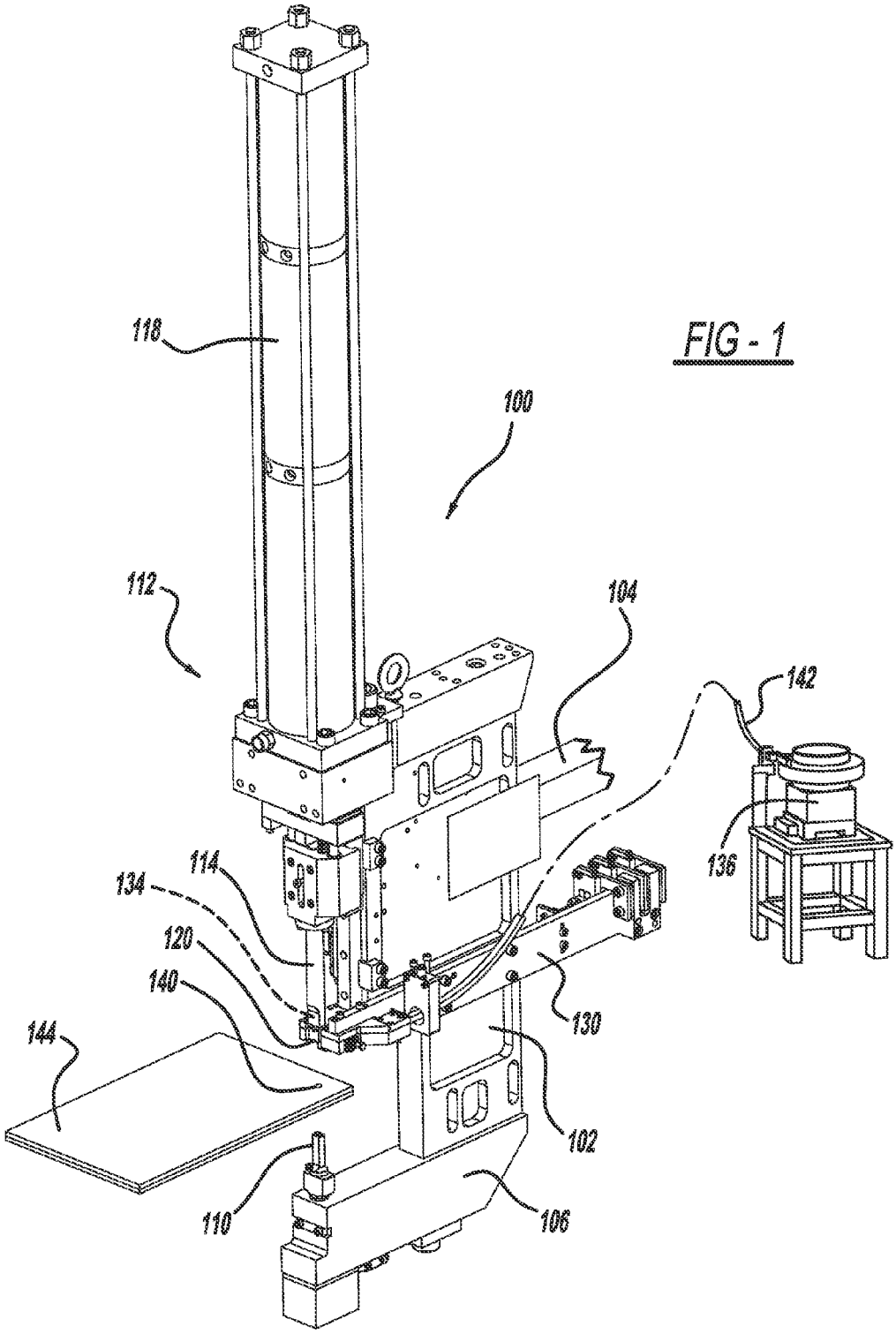
FIG. 1 is a perspective view showing a rivet machine constructed in accordance to one example of the present teachings.
Figure 2:
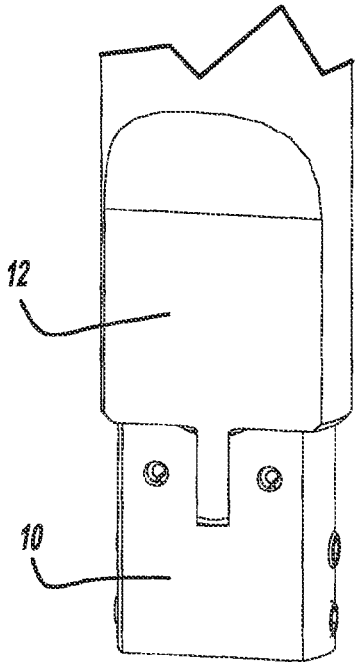
FIG - 2 Prior Art
FIG. 2 is a front perspective view of a guide head and punch guide according to prior art.
Figure 3:
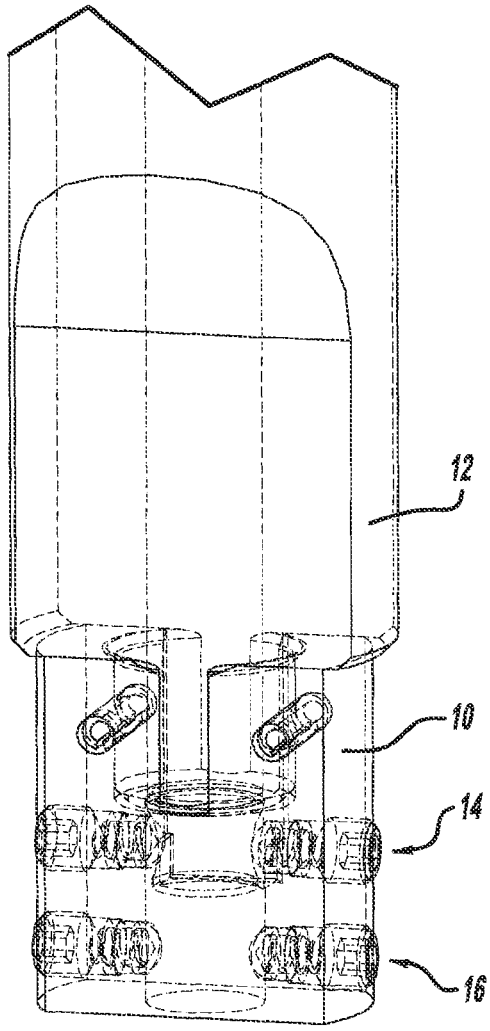
FIG - 3 Prior Art
FIG. 3 is a phantom view of the guide head and punch guide of FIG. 2 according to prior art.
Figure 4:
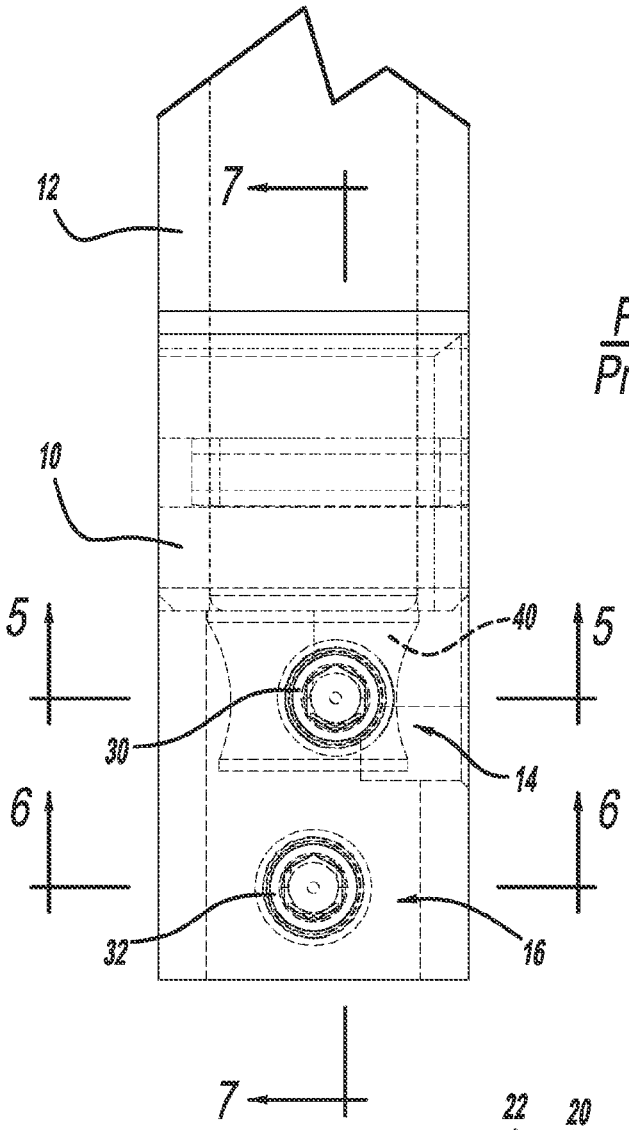
FIG - 4 Prior Art
FIG. 4 is a side view of the guide head and punch guide of FIG. 2 according to prior art.
Figure 5:
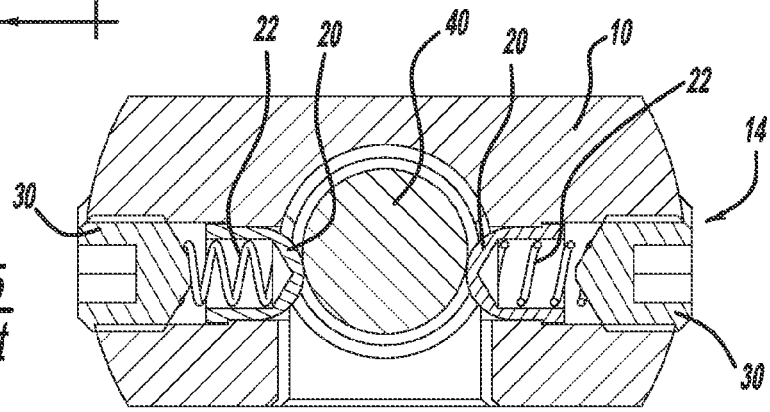
FIG - 5 Prior Art
FIG. 5 is a cross-sectional view taken along lines 5-5 of the guide head and punch guide of FIG. 2 according to prior art.
Figure 6:
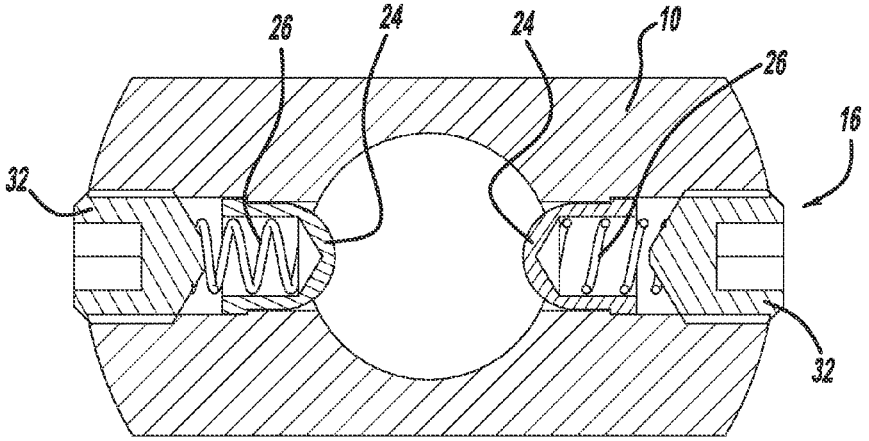
FIG - 6 Prior Art
FIG. 6 is a cross-sectional view taken along lines 6-6 of the guide head and punch guide of FIG. 4 according to prior art.
Figure 7:
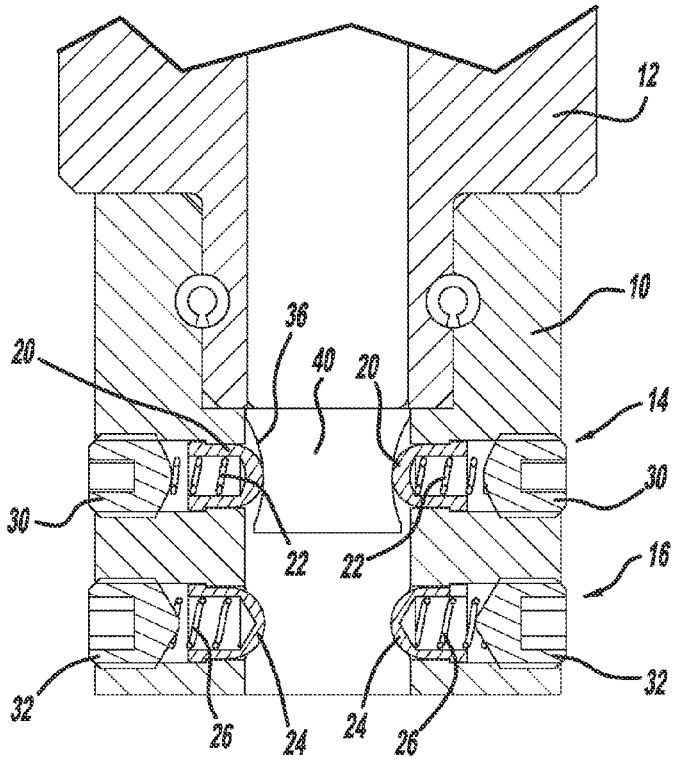
FIG - 7 Prior Art
FIG. 7 is a cross-sectional view taken along lines 7-7 of the guide head and punch guide of FIG. 4 according to prior art and shown with a rivet urged by a punch to a first position.
Figure 8:
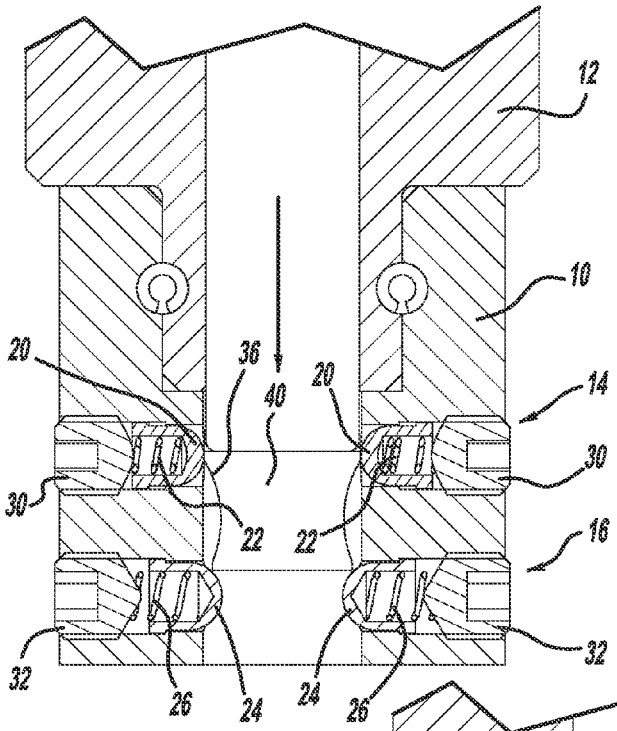
FIG - 8 Prior Art
FIG. 8 is a cross-sectional view taken along lines 7-7 of the guide head and punch guide of FIG. 4 according to prior art and shown with a rivet urged by a punch to a second position.
Figure 9:
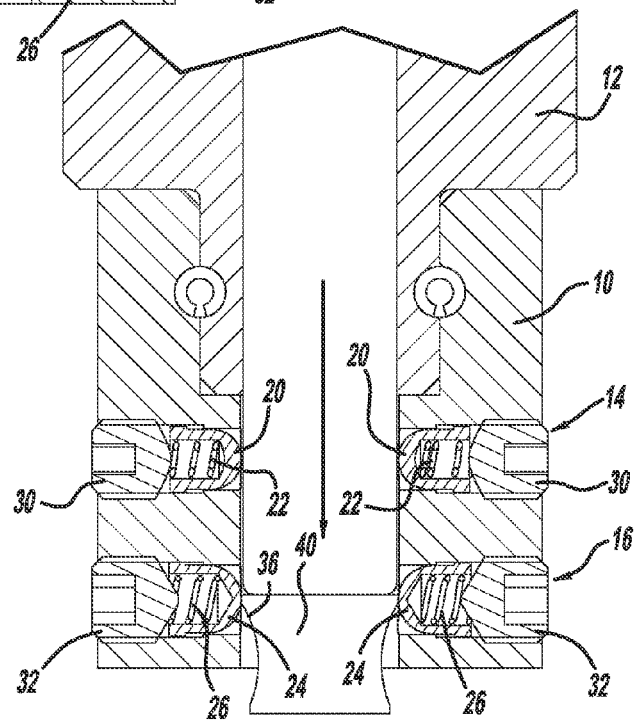
FIG - 9 Prior Art
FIG. 9 is a cross-sectional view taken along lines 7-7 of the guide head and punch guide of FIG. 4 according to prior art and shown with a rivet urged by a punch to a third position.
Figure 10:
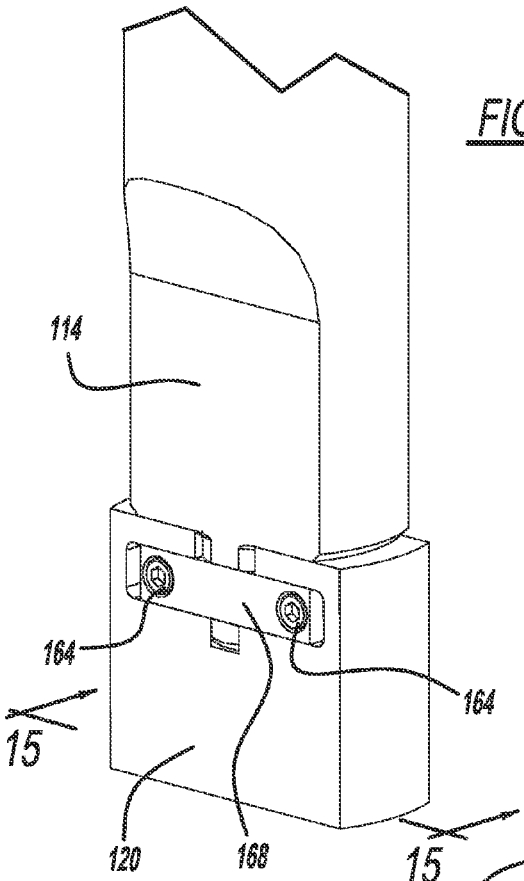
FIG. 10 is a front perspective view of a guide head and punch guide constructed in accordance to the present teachings.
Figure 11:
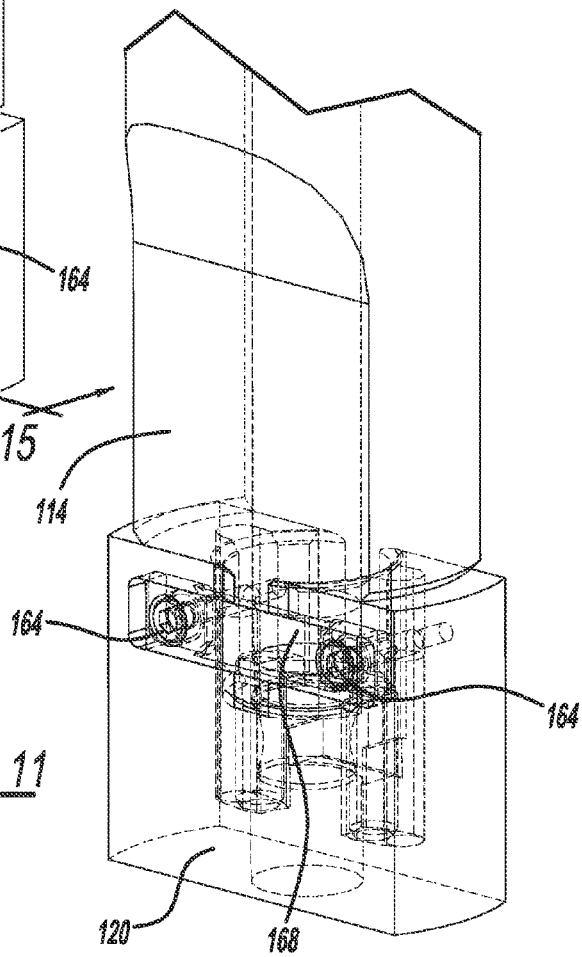
FIG. 11 is a phantom front perspective view of the guide head and punch guide of FIG. 10.
Figure 12:
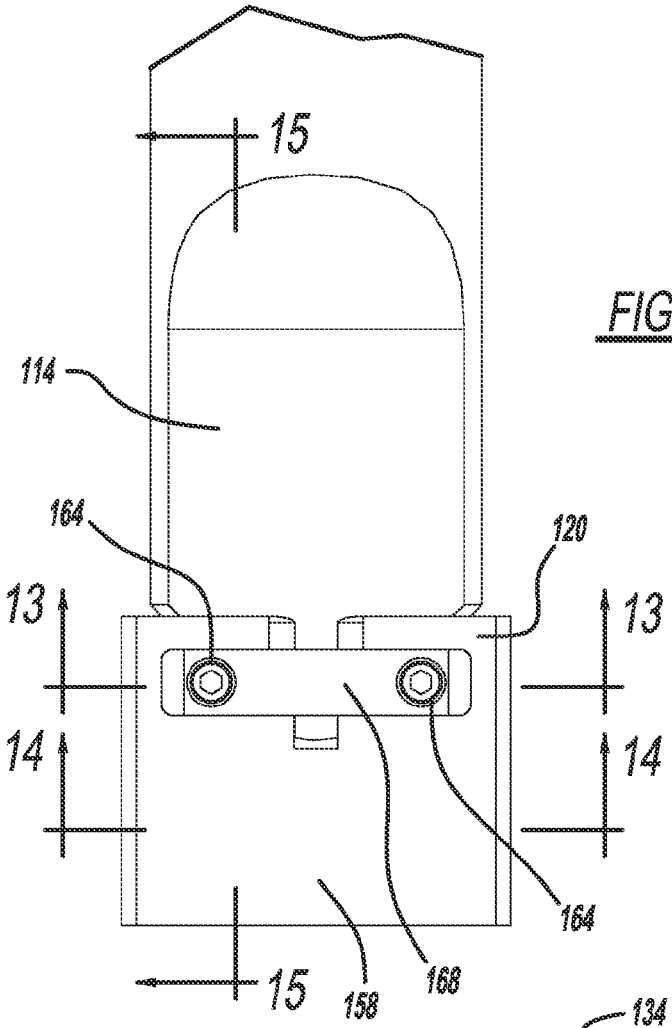
FIG. 12 is a front view of the guide head and punch guide of FIG. 10.
Figure 13:
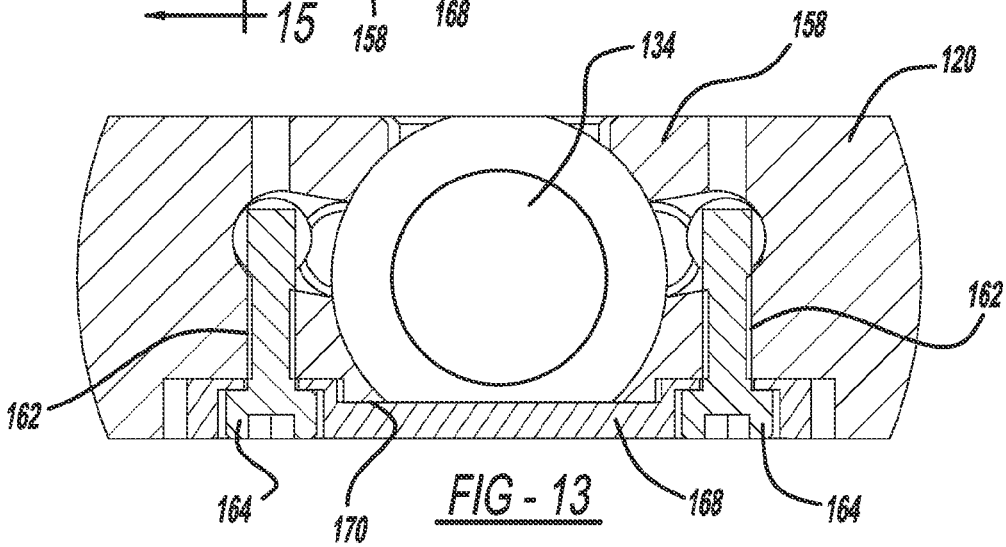
FIG. 13 is a cross-sectional view taken along lines 13-13 of the rivet guide head and punch guide of FIG. 12.
Figure 14:
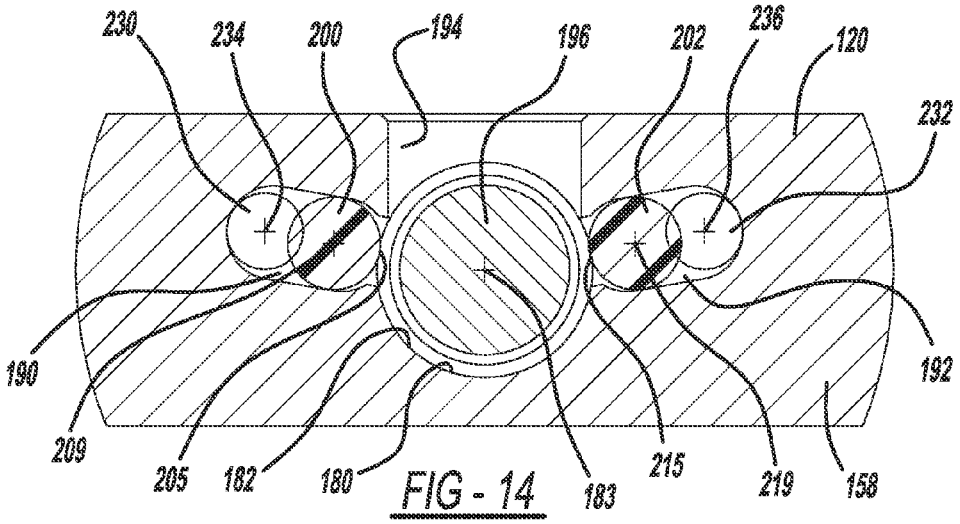
FIG. 14 is a cross-sectional view taken along lines 14-14 of the rivet guide head and punch guide of FIG. 12.

Referring to FIG. 1, a rivet setting machine 100 includes a C-frame 102 which is mounted to an articulated robotic arm 104 for automated movement between various operating positions within an industrial factory. An anvil section 106 of the C-frame 102 has a die 110 mounted thereon. A ram assembly 112 is mounted to the opposite end of the C-frame 102 and includes an air-over-oil fluid actuated cylinder 118, a punch guide 114, and a rivet guide head 120. Alternately, the cylinder 118 can be solely hydraulically, pneumatically, or less preferably, servo-motor actuated. A rivet feeding mechanism 130 is mounted to a generally middle segment of the C-frame 102 and is elongated in a direction generally perpendicular to the movement direction of a punch 134 that translates relative to the punch guide 114.

A vibratory bowl 136 supplies individualized fasteners, such as a self-piercing rivet 140, to the feeding mechanism 130 via a pneumatically pressurized and flexible hose 142. When multiple workpiece sheets 144 are inserted between the punch guide 114 and the die 110, the punch 134 will thereafter push and set the rivet 140 into the upper surface of the workpieces 144 as they are being compressed against the die 110. The self-piercing rivet 140 is preferably a solid (e.g., not hollow) rivet, which punches out a blank or slug from the previously unpunched workpiece areas. The rivet ends are generally flush with the adjacent outside surfaces of the workpieces 144. One such self-piercing rivet is disclosed in U.S. Pat. No. 4,130,922 entitled "Headless Riveting System," which issued to Koett on Dec. 26, 1978, which is incorporated by reference herein. Additional description of the rivet setting machine 100 may also be found in commonly owned and currently pending U.S. patent application Ser. No. 13/162,974, which is expressly incorporated herein by reference.

Figure 15:
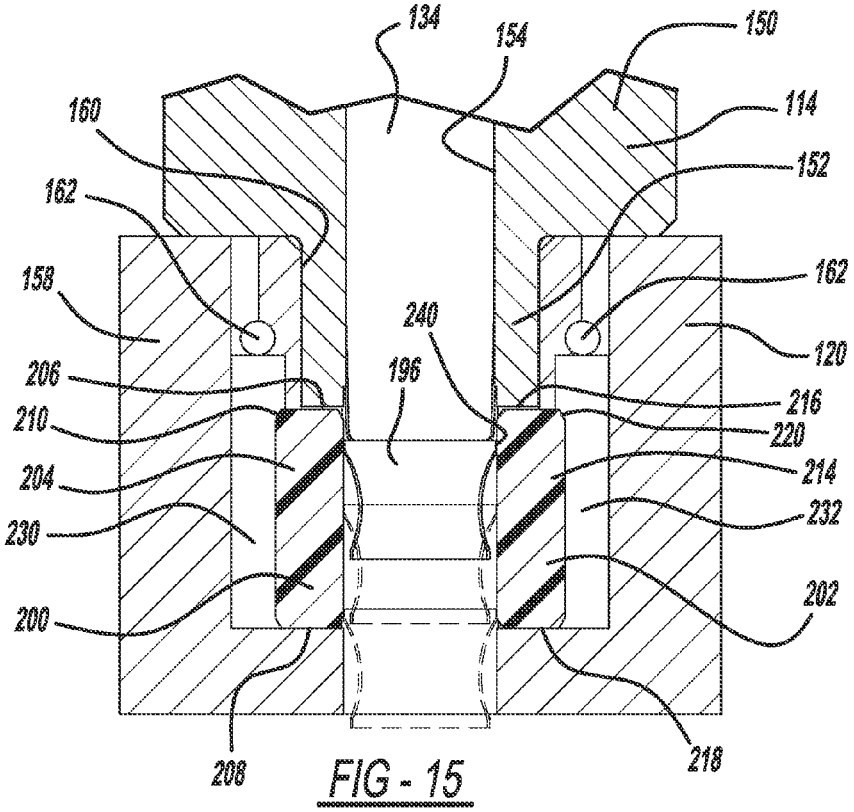
FIG. 15 is a cross-sectional view taken along lines 15-15 of the rivet guide head and punch guide of FIG. 10 and shown with the rivet in phantom view during a sequential drive stroke.

With particular reference now to FIGS. 10-15, the punch guide 114 and the rivet guide head 120 will be described. The punch guide 114 generally includes a punch guide body 150 having a nose 152 (FIG. 15). The punch guide body 150 generally defines a punch guide bore 154 that receives the punch 134. The rivet guide head 120 generally includes a rivet guide body 158 that defines a guide head opening 160 that receives the nose 152 of the punch guide 114 (see FIG. 15). The rivet guide head 120 further defines a pair of apertures 162 that receive a corresponding pair of fasteners 164 therein. The fasteners 164 can generally affix a connecting bar 168 into a recess 170 in the rivet guide head 120 (see FIG. 13) to couple the guide head 120 to the punch guide 114.

The rivet guide body 158 includes a rivet guide surface 180 defined along a rivet guide bore 182 having a guide bore axis 183. The rivet guide body 158 further defines a first lateral cavity 190 and a second lateral cavity 192. The rivet guide body 158 includes a rivet entry slot 194 (FIG. 14) that is configured to receive the rivet 196.

A first guide pin 200 and a second guide pin 202 are disposed in the rivet guide body 158 of the rivet guide head 120. The first and second guide pins 200 and 202 are formed from a rigid material such as hardened steel. The first guide pin 200 includes an elongated body 204 having an outer engagement surface 205 that extends between a first terminal end 206 and a second terminal end 208. The elongated body 204 extends along a first guide pin axis 209. The first guide pin axis 209 is generally parallel to and laterally offset relative to the guide bore axis 183. The first guide pin 200 has a chamfered leading end 210. The second guide pin 202 includes an elongated body 214 having an outer engagement surface 215 that extends between a first terminal end 216 and a second terminal end 218. The elongated body 214 extends generally along a second guide pin axis 219. The second guide pin axis 209 is generally parallel to and laterally offset relative to the guide bore axis 183. The second guide pin 202 has a chamfered leading end 220. The first guide pin 200 is received by the first lateral cavity 190 of the rivet guide body 158. Similarly, the second guide pin 202 is received by the second lateral cavity 192 of the rivet guide body 158. The first and second guide pins 200 and 202 are trapped in the rivet guide body 158 by the nose 152 of the punch guide body 150 subsequent to attaching the fasteners.

A first biasing member 230 is disposed in the first lateral cavity 190 of the rivet guide body 158. A second biasing member 232 is disposed in the second lateral cavity 192 of the rivet guide body 158. The first and second biasing members 230 and 232 are formed from elastomeric material. In one example, the biasing members 230 and 232 are chord springs having a durometer of between 30 and 70 and preferably 40. The first and second biasing members 230 and 232 can be elongated members that extend generally along respective axes 234 and 236.

The first and second biasing members 230 and 232 are configured to bias the first and second guide pins 200 and 202, respectively, in a direction toward the guide bore axis 183. As will become appreciated from the following discussion, the first and second biasing members 230 and 232 cooperate to urge the first and second guide pins 200 and 202, respectively, into contact with the rivet 196 such that a trailing edge outer surface 240 of the rivet 196 slidably engages the respective outer engagement surfaces 205 and 215 of the first and second guide pins 200 and 202 through the drive stroke as shown in FIG. 15. The trailing edge outer surface 240 of the rivet 196 also engages the rivet guide surface 180 of the rivet guide bore 182 in the rivet guide body 158 (see FIG. 14).

During the drive stroke, the first and second guide pins 200 and 202 may deflect initially outwardly such as from a position shown in FIG. 19 to a position shown in FIG. 15 to accommodate the trailing edge 240 of the rivet 196. The first and second guide pins 200 and 202 remain substantially static through a remainder of the drive stroke, as illustrated in FIG. 15 until the outermost trailing edge 240 of the rivet 196 clears the second terminal ends 208 and 218, respectively, of the first and second guide pins 200 and 202. The configuration of the first and second guide pins 200 and 202 therefore discourages a rivet 196 from being caught or otherwise hung up by structure of the rivet guide head 120 through the drive stroke such as may be experienced with the guide head 10 as described above with respect to the prior art. Furthermore, the rivet guide head 120 comprises fewer parts and requires less moving components during use.

Figure 16:
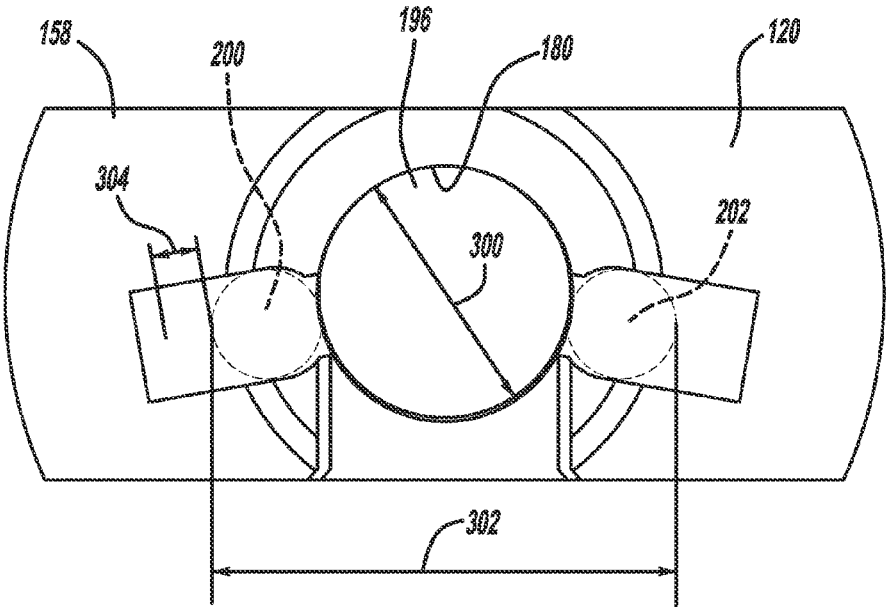
FIG. 16 is a cross-sectional view taken generally through the rivet guide head and illustrating guide pins deflected outwardly to a first position corresponding to a maximum diameter rivet being located into the rivet guide bore.

With reference now to FIGS. 16-19, exemplary dimensions of various components in the rivet guide head 120 will be described. FIG. 16 generally illustrates an exemplary deflection of the pins 200 and 202 for a rivet 196 having a diameter 300 where the rivet 196 is engaged to the rivet guide surface 180. The diameter 300 is 0.286 inches. The first and second guide pins 200 and 202 are deflected laterally a distance 302. The distance 302 is 0.529 inches. The guide pins 200 and 202 can each be deflected to a location that measures distance 304 relative to a static surface on the rivet guide head 120. The distance 304 is 0.053 inches.

Figure 17:
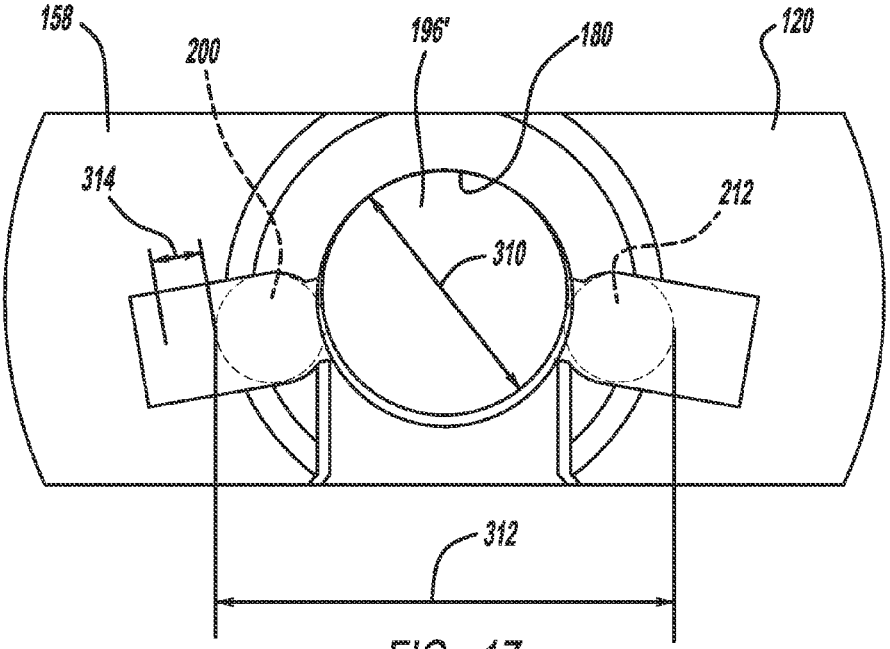
FIG. 17 is a cross-sectional view taken generally through the rivet guide head illustrating the guide pins deflected to a second position corresponding to a minimum diameter rivet being located into the rivet guide bore.

FIG. 17 generally illustrates an exemplary deflection of the pins 200 and 202 for a rivet 196' having a diameter 310 where the rivet 196' is engaged to the rivet guide surface 180. The diameter 310 is 0.278 inches. The first and second guide pins 200 and 202 are deflected laterally a distance 312. The distance 312 is 0.520 inches. The guide pins 200 and 202 can each be deflected to a location that measures a distance 314 relative to a static surface on the rivet guide head 120. The distance 314 is 0.057 inches.

FIG. 18 generally illustrates an exemplary deflection of the pins 200 and 202 at a diameter 300. The diameter 300 is 0.286 inches. The first and second guide pins 200 and 202 are deflected laterally a distance 332. The distance 332 is 0.536 inches. The guide pins 200 and 202 can each be deflected to a location that measures distance 304 relative to a static surface on the rivet guide head 120. The distance 304 is 0.053 inches.

FIG. 19 generally illustrates the pins 200 and 202 with no rivet in the rivet guide head 120. The first and second guide pins 200 and 202 are located laterally a distance 332. The distance 332 is 0.507 inches. The guide pins 200 and 202 can each be located at a position that measures a distance 334 relative tot a static surface on the rivet guide head 120. The distance 334 is 0.064 inches. A diameter 340 is defined by the opposing surfaces of the rivet entry slot 194. A diameter 344 is defined between the first and second guide pins 200 and 202. The diameter 344 is 0.268 inches. An angle 346 is defined between the second guide pin axis 219 and a center point 350 of the diameter 340. The angle is 21.55 degrees.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A rivet guide head that guides a rivet during a rivet machine drive stroke, the rivet drive head comprising:

a rivet guide body having a rivet guide surface defined along a rivet guide bore having a guide bore axis; and a first elongated guide pin disposed in the rivet guide head that extends along a first guide pin axis and has a convex outer engagement surface, the guide bore axis being substantially parallel to the first guide pin axis, wherein the first guide pin axis is offset from the rivet guide bore; wherein the rivet guide head is configured to guide the rivet along the outer engagement surface of the first elongated guide pin during the drive stoke.

2. The rivet guide head of claim 1 wherein the first elongated pin deflects laterally outwardly during the drive stroke.

3. The rivet guide head of claim 2, further comprising a first biasing member disposed in the rivet guide head and that is configured to bias the first elongated guide pin in a direction toward the guide bore axis.

4. The rivet guide head of claim 3 wherein the first biasing member comprises an elongated elastomeric member that extends along a first member axis that is parallel and laterally offset from the guide bore axis.

5. The rivet guide head of claim 4 wherein the elongated elastomeric member comprises a chord spring formed of rubber having a durometer of between 30 and 70.

6. The rivet guide head of claim 2 wherein the rivet guide head is configured to slidably and concurrently engage the rivet at the rivet guide surface with the engagement surface of the first elongated member during the drive stroke.

7. The rivet guide head of claim 6 wherein the first elongated pin deflects to a guide position upon initial engagement with the rivet and substantially remains at the guide position subsequent to the initial engagement through the drive stroke until the rivet is urged to a location beyond a terminal end of the first elongaged pin.

8. The rivet guide head of claim 3, further comprising:

a second elongated guide pin disposed in the rivet guide head that extends along a second guide pin axis and has an outer engagement surface; and a second biasing member disposed in the rivet guide head and that is configured to bias the second elongated guide pin in a direction toward the guide bore axis;

wherein the outer engagement surfaces of the first and second elongated pins concurrently engages the rivet during the guide stroke.

9. The rivet guide head of claim 1 wherein the first elongated guide pin has a chamfered leading end.

10. The rivet guide head of claim 1, further comprising:

a rivet machine comprising: a punch guide; and a punch that translates relative to the punch guide and directs the rivet into the rivet guide bore.

11. A rivet guide head that guides a rivet, the rivet guide head comprising: a rivet guide body having a rivet guide surface defined along a rivet guide bore having a guide bore axis; a first elastomeric member disposed in the rivet guide body; and a first elongated guide pin disposed in the rivet guide head at a location intermediate the first elastomeric member and the guide bore axis, the first elongated guide pin having a cylindrically convex outer engagement surface; wherein the rivet guide head is configured to continuously guide the rivet along a chamfered leading end and the outer engagement surface of the first elongated guide pin while the first elastomeric member biases the first elongated guide pin laterally toward the rivet, wherein the chamfered leading end is positioned at a top portion of the first elongated guide pin.

12. The rivet guide head of claim 11 wherein the first elongated pin deflects laterally away from the guide bore axis during engagement with the rivet.

13. The rivet guide head of claim 11 wherein the first elastomeric member comprises an elongated chord spring that extends along a first member axis that is parallel and laterally offset from the guide bore axis.

14. The rivet guide head of claim 13 wherein the chord spring is formed of rubber having a durometer of between 30 and 70.

15. The rivet guide head of claim 12 wherein the rivet guide head is configured to slidably and concurrently engage the rivet at the rivet guide surface with the engagement surface of the first elongated member.

16. The rivet guide head of claim 15 wherein the first elongated pin deflects to a guide position upon initial engagement with the rivet and substantially remains at the guide position subsequent to initial engagement through until the rivet is urged to a location adjacent a terminal end of the first elongated pin.

17. The rivet guide head of claim 11, further comprising:

a second elongated guide pin disposed in the rivet guide head that extends along a second guide pin axis and has an outer engagement surface; and a second biasing member disposed in the rivet guide head and that is configured to bias the second elongated guide pin in a direction toward the guide bore axis;

wherein the outer engagement surfaces of the first and second elongated pins concurrently engages the rivet.

18. The rivet guide head of claim 11 wherein the first elongated guide pin is formed of hardened steel.

19. The rivet guide head of claim 11, further comprising:

a rivet machine comprising: a punch guide; and a punch that translates relative to the punch guide and directs the rivet into the rivet guide bore.

20. A rivet guide head that guides a rivet during a rivet machine drive stroke, the rivet drive head comprising: a rivet guide body having a rivet guide surface defined along a rivet guide bore having a guide bore axis;

a first and a second elastomeric member disposed in the rivet guide body;

a first elongated guide pin disposed in the rivet guide head at a location intermediate the first elastomeric member and the guide bore axis, the first elongated guide pin having an outer engagement surface; and a second elongated guide pin disposed in the rivet guide head at a location intermediate the second elastomeric member and the guide bore axis, the second elongated guide pin having an outer engagement surface;

wherein the rivet guide head is configured to continuously guide the rivet along contact points that consist of the rivet guide surface and chamfered leading ends and the outer engagement surfaces of the respective first and second elongated guide pins while the first and second elastomeric members biases the first and second elongated guide pins, respectively, laterally toward the rivet wherein the chamfered leading ends are disposed at top portions of the first and second elongated guide pins, respectively.

21. The rivet guide head of claim 20 wherein the first and second elastomeric members comprise chord springs having a durometer of between 30 and 70.

22. The rivet guide head of claim 20 wherein the first and second elongated guide pins are formed of hardened steel.

23. The rivet guide head of claim 20 wherein the contact points of the guide head are configured to engage only a trailing outer diameter of the rivet.

24. The rivet guide head of claim 20, further comprising:

a rivet machine comprising: a punch guide; and a punch that translates relative to the punch guide and directs the rivet into the rivet guide bore.

* * * * *

UNITED STATES PATENT AND TRADEMARK OFFICE

CERTIFICATE OF CORRECTION

PATENT NO. : 8,869,365 B2
APPLICATION NO. : 13/167856
DATED : October 28, 2014
INVENTOR(S) : William M. Faitel It is certified that error appears in the above-identified patent and that said Letters Patent is hereby corrected as shown below:

In the Specification

Column 4, line 23;
"209" should be --219--.

Column 5, line 36;
"tot" should be --to--.

In the Claims

Column 6;
Claim 7, line 23;
"elongaged" should be --elongated--.
Claim 8, line 32;
"engages" should be --engage--.

Column 7, claim 17, line 15;
"engages" should be --engage--.

Column 8, claim 20, line 12;
"biases" should be --bias--.

Signed and Sealed this
Seventeenth Day of March, 2015

Michelle K. Lee

Michelle K. Lee
*Director of the United States Patent and Trademark Office*